US006243052B1

(12) United States Patent
Goldstein et al.

(10) Patent No.: US 6,243,052 B1
(45) Date of Patent: Jun. 5, 2001

(54) LOW PROFILE PANEL-CONFIGURED HELICAL PHASED ARRAY ANTENNA WITH PSEUDO-MONOPULSE BEAM-CONTROL SUBSYSTEM

(75) Inventors: M. Larry Goldstein, Palm Bay; Emil G. Svatik, Jr., Sebastian; James B. Offner, Melbourne; William C. Daffron, Cocoa; Alen Fejzuli, Palm Bay, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/441,696

(22) Filed: Nov. 16, 1999

(51) Int. Cl.[7] ..... H01Q 1/36
(52) U.S. Cl. ..... 343/895; 343/766; 343/853
(58) Field of Search ..... 343/845, 853, 343/757, 758, 766, 824, 857, 858; H01Q 1/36

(56) References Cited

U.S. PATENT DOCUMENTS 3,673,606 * 6/1972 Maune ..... 343/766
4,427,984 * 1/1984 Anderson ..... 343/895
4,779,097 * 10/1988 Morchin ..... 343/757
5,216,436 * 6/1993 Hall et al. ..... 343/895
5,258,771 * 11/1993 Praba ..... 343/895
5,345,248 * 9/1994 Hwang et al. ..... 343/895
5,892,480 * 4/1999 Killen ..... 343/895
5,995,062 * 11/1999 Denney et al. ..... 34/853

* cited by examiner

*Primary Examiner*—Don Wong
*Assistant Examiner*—Hoang Nguyen
(74) *Attorney, Agent, or Firm*—Allen, Dyer, Doppelt, Milbrath & Gilchrist, P.A.

(57) ABSTRACT

A phased array antenna has a spatially periodic array of tapered pitch helical antenna elements disposed on a first side of a panel, and RF interface circuitry on a second side the panel. For a 'pseudo'-monopulse tracking mode of operation, single bit, digitally controlled phase shift elements of the RF circuitry impart sequentially different amounts of phase shift to the energy derived from the spatial sections of the antenna elements. This causes a sequential electrical tilting of the beam pattern of the array in a plurality of respectively different directions relative to boresight. For each sequential tilt of the beam pattern, signals representative of the energy received by each of plural quadrants of the array are summed and stored. The information in the summed and stored signals is processed in accordance with a monopulse-based beam tracking algorithm, and a positioning system control unit controllably adjusts the physical orientation of the panel in azimuth and elevation in accordance with processed information.

17 Claims, 4 Drawing Sheets

| BEAM/PHASE SHITER STATE | Q1 | Q2 | Q3 | Q4 |
|---|---|---|---|---|
| BORESIGHT | 0 | 0 | 0 | 0 |
| LEFT | 1 | 0 | 0 | 1 |
| RIGHT | 0 | 1 | 1 | 0 |
| UP | 0 | 0 | 1 | 1 |
| DOWN | 1 | 1 | 0 | 0 |

LOW PROFILE PANEL-CONFIGURED HELICAL PHASED ARRAY ANTENNA WITH PSEUDO-MONOPULSE BEAM-CONTROL SUBSYSTEM

FIELD OF THE INVENTION

The present invention relates in general to communication systems, and is particularly directed to a new and improved, low profile, panel-configured helical phased array antenna architecture, that is configured for use with a mobile (e.g, land vehicle) platform, and which contains an integrated pseudo-monopulse based, beam-aiming (tilting) subsystem, that is coupled to a platform positioning system so as to facilitate pointing of the antenna along the path of, a (low earth orbit) satellite.

BACKGROUND OF THE INVENTION

In order to be certified for acceptance with a given (satellite) communication system, the directivity pattern of an antenna relative to a target (e.g., satellite) must conform with prescribed main lobe and sidelobe characteristics. Where the antenna is to be installed at a fixed, land-based location, and there are no restrictions on the physical parameters and cost of the antenna, satisfying a given performance specification may be readily accomplished by suitable design of a conventional (parabolic) dish antenna and associated monopulse hardware configuration. However, where the environment in which the antenna is to deployed is mobile and potentially hostile, a variety of physical parameters come into play, which effectively negate the use of a large dish and its associated beam steering components.

For example, in a tactical (mobile) environment, where detection and therefore survivability of a communication system may depend upon the effective profile or observable footprint of the antenna, it is highly desirable to make the antenna as small as possible. However, as the size of the antenna is reduced, so is its available energy collecting aperture. A further complication is the fact that it may be necessary to dynamically position or orient the antenna, in order to follow or track a (low earth orbit) satellite. Even if a reduced diameter dish architecture is employed, its moment of inertia and observable profile is further enlarged by the auxiliary (azimuth and elevation sum and difference horns) and waveguide and stripline 'plumbing' of the associated (monopulse) tracking control subsystem. Moreover, should it be necessary to change the operational parameters of such a dish-based architecture, major disassembly and retrofitting of its associated waveguide hardware is required.

SUMMARY OF THE INVENTION

In accordance with the present invention, such shortcomings of conventional, relatively massive parabolic (e.g., Cassegrain) antenna architectures are effectively obviated by a new and improved 'low profile', panel-configured helical phased array antenna and integrated beam-aiming (tilting) subsystem architecture. As will be described this architecture not only readily lends itself to being implemented with commercial off the shelf (COTS) components, to reduce its cost, but it may be operated in a 'pseudo'-monopulse mode, to facilitate operation of a mobile platform-mounted positioner, and exhibits a performance that conforms with industry standards, such as the DSCS (defense satellite communication system) specification.

For low observability, the helical antenna arrays and RF circuit components of the antenna are mounted to a generally flat plate or panel. Transmit and receive arrays of tapered pitch helical antenna elements are mounted side-by-side upon a front side of the panel, while RF circuit components associated with the transmit and receive arrays are mounted to a rear side of the plate, which avoids aperture blockage. The parameters of the tapered pitch helices and their respective locations are preferably defined to constrain the sidelobes of the antenna's directivity pattern within with the DISA envelope of DSCS certification requirements.

Each of the respective transmit and receive arrays is configured as a compact, spatially periodic distribution of tapered pitch helical antenna elements to minimize the height of the antenna. Element-to-element spacing is minimized for maximum aperture efficiency. In a preferred embodiment, each array geometry is that of a circular truncation of an equiangular (60°) triangle-based lattice into sixty-four locations, subdivided into four quadrants of sixteen elements/quadrant. To achieve a substantial reduction in the sidelobe envelope for complying with the DISA specification, the lattice geometries of the arrays have a 'rotated' orientation on the support plate.

By 'rotated' orientation is meant that each of the three sets of parallel rows of the 60° lattice geometry of a respective array is rotationally offset relative to both the target travel path and the normal to that path projected in the plane of the array. The projection of the antenna's scan plane upon the array is defined by the orientation of the plate in azimuth (AZ) and elevation (EL), under the control of the associated positioning subsystem upon which the plate is mounted, and corresponds to the projection upon the array of the travel path of the satellite being tracked.

To adjust the antenna boresight, the support plate is mounted to an associated positioning subsystem, such as but not limited to an associated azimuth AZ and elevation EL ($\theta/\Phi$) positioning subsystem. Such a subsystem may effect a change in elevation by rotating the plate some angle $\Phi$ about an axis that is parallel to upper and lower parallel edges of the plate. To effect a change in azimuth, the positioning subsystem rotates the plate some angle $\theta$ about an axis, the normal projection of which upon the plate is parallel to its two parallel side edges. Positioning control commands for driving the positioning subsystem are supplied by an associated system supervisory host computer.

The RF components for the transmit array on the rear side of the support plate are comprised of COTS components, and include a four-way power divider coupled to four, sixteen-way power dividers, whose outputs are coupled to feed ports of an associated set of sixteen antenna elements within the four spatial quadrants of the transmit array. For the adjacent receive array, the output ports of each of the sixteen antenna elements of its four quadrants are coupled to respective ones of a set of four sixteen-way microstrip power combiners, whose outputs are directly coupled to associated combine filters to suppress the RF band of the signals emitted by the adjacent transmit array. These combine filters are coupled through low noise amplifiers to a four-way phase shifter and combiner.

In accordance with the invention, the phase shifter and combiner is operative, under control of the host processor, to impart a controlled amount of phase shift to each receive array quadrant signal path. It then sums the resulting (phase-shifted) inputs from the four quadrants of the receive array. The output of the four-way combiner is coupled through a further combine filter-LNA stage and routed therefrom to downstream transceiver circuitry.

To selectively impart a controlled amount of phase shift to each input path, the four-way combiner includes four digitally controlled, single-bit, quadrant phase shifters. The phase shift imparted by each phase shift element is programmable; whether that control voltage is applied to the phase shift element is determined by the value of the single bit. The use of digitally controlled phase shifters facilitates adjustments to the associated pseudo-monopulse tracking subsystem, and allows the main beam to be electrically selectively scanned, or sequentially stepped up to a prescribed offset angle (e.g., 1°) from boresight, in order to extract azimuth and elevation error signals used by the positioning subsystem to correct, as necessary, the pointing of the antenna. At times other than this tracking mode, the digital programmability of each of the phase shifters allows the beam pattern of the array to be controllably electrically tilted at a selected inclination angle off boresight, under user control. This feature allows a trade-off between and simplifies optimization of tracking performance and gain/thermal noise ratio (G/T).

DETAILED DESCRIPTION

Figure 1:
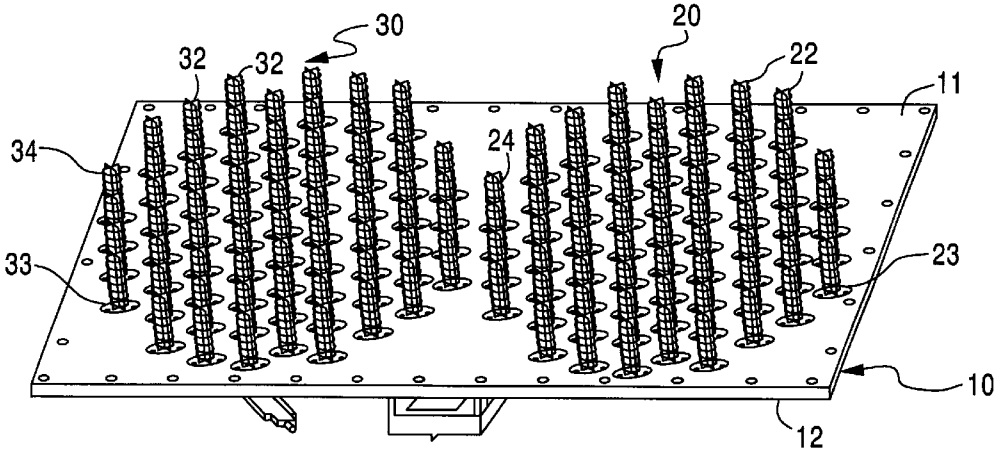
FIG. 1 is a diagrammatic perspective view of the antenna element side of the low profile, panel-configured helical phased array antenna architecture of the invention.

Attention is initially directed to FIG. 1, which is a diagrammatic perspective view of the front (antenna element) side of the low profile, panel-configured helical phased array antenna system of the invention. As shown therein, in order to achieve a relatively low or 'thin' profile, the principal support member upon which the various antenna and RF circuit components of the antenna system are mounted in a compact integrated fashion comprises a flat plate or panel 10. While the perimeter of the plate 10 is shown as generally rectangular, other shapes may be used. The choice of a rectangular plate provides a high degree of support real estate occupancy efficiency, as it allows two, equal area, spatially periodic transmit and receive arrays of antenna elements to be mounted side-by-side in a minimum amount of space.

A first, front side 11 of the plate 10 serves as a mounting or support surface for each of a transmit array 20 of tapered pitch helical antenna elements 22 and a receive array 30 of tapered pitch helical antenna elements 32. A second, rear side 12 of the plate 10 serves as a mounting or support surface for the RF circuit components for each of the transmit and receive arrays, to be described below with reference to FIGS. 4 and 5. As a non-limiting example, each tapered pitch antenna element 22/32 may be configured in the manner described in U.S. Pat. No. 5,892,480 (or '480 patent) issued Apr. 6, 1999, to William D. Killen, entitled: "Variable Pitch Angle Axial Mode Helical Antenna," assigned to the assignee of the present application and the disclosure of which is incorporated herein.

As described therein a respective tapered pitch helical antenna 22/32 may comprise a generally rectilinear support shaft or mandrel (having a cylindrical or square cross section, as non-limiting examples). The base of the support mandrel about which the helical antenna is wound may be affixed by way of a mounting bracket 23/33 to a corresponding aperture in the support plate 10, so that the helical antenna element extends normal to the front surface 11 of the support plate 10 and is parallel to the antenna's boresight axis. Extending from the distal end of each helical antenna element 22/32 is a helical winding 24/34, the pitch of which tapers from a maximum pitch at the distal end to a minimum pitch at its base. At the base, the helical winding is coupled to an SMA connector, which provides connectivity with the RF circuit components on the rear side 12 of the panel 10.

The parameters of the individual tapered pitch helical antenna elements 22/32 (e.g., length, radius, variable pitch, conductor size, geometric layout, rotation relative to orbit projection, mutual spacing, and the like) are tailored for the intended performance requirements of the phased array. Preferably, the physical dimensions for the helices of the transmit and receive arrays 20 and 30 are optimized for gain and axial ratio performance in their respective bands. In accordance with a non-limiting but preferred embodiment, the parameters of the tapered pitch helices of the phased array architecture of the present invention are defined so as to constrain the sidelobes of the antenna's directivity pattern within with the DISA envelope of DSCS certification requirements.

One way to achieve a sidelobe constrained directivity pattern would be to arrange a plurality of relatively large gain tapered pitch helical antenna elements (of the type described in the '480 patent) in an a periodic spatial distribution, to suppress unwanted grating lobes. An example of such an aperiodic array is described in co-pending U.S. patent application to L. Goldstein et al, Ser. No. 09/106,433 (the '433 application), filed Jun. 26, 1998, entitled: "Gain-Optimized Lightweight Helical Antenna Arrangement," assigned to the assignee of the present application and the disclosure of which is incorporated herein. A non-limiting example of an environment where such an aperiodic distribution of high gain helical antenna elements may be employed is on board a ship. However, the effective profile of such a structure is inherently considerably larger than (and not desirable for) a tactical land based vehicle, such as a HUMVEE.

Figure 2:
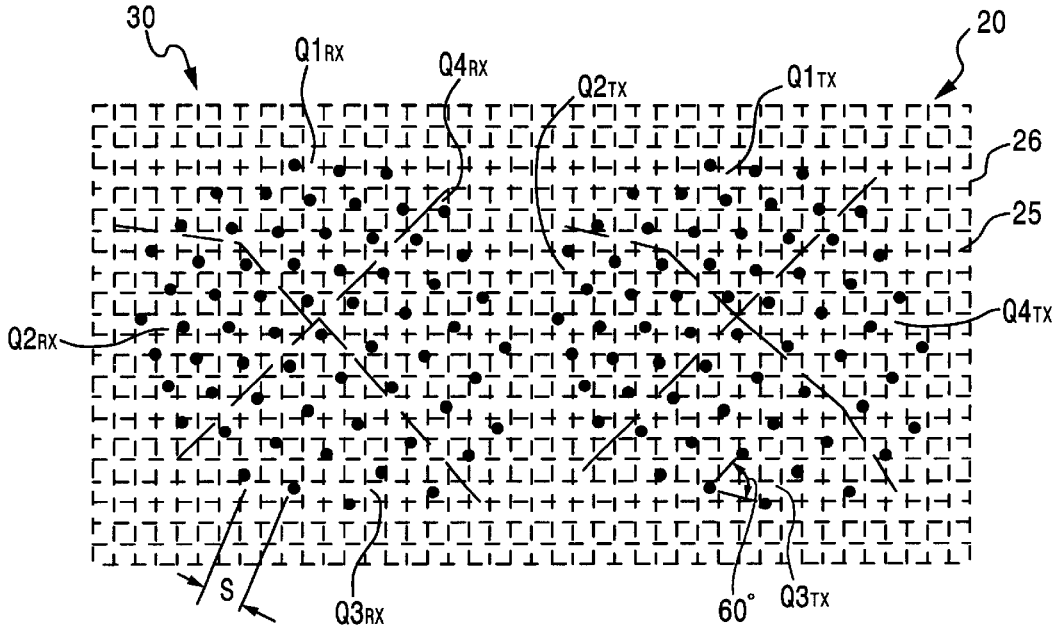
FIG. 2 is a geometric plan view of transmit and receive antenna arrays of the antenna architecture of FIG. 1.

As shown in the geometric plan view of FIG. 2, the present invention avoids this potential problem by configuring each of the respective transmit and receive arrays 20 and 30 as a spatially periodic, or 'regular', distribution of tapered pitch helical antenna elements, the gains (and therefore the lengths/profiles) of which are smaller than those of the aperiodic phased array of the '433 application. This reduces the height of the antenna, and thereby provides a relatively compact spatial architecture, that is particularly suited for a constrained aperture tactical environment.

In accordance with the non-limiting but preferred embodiment shown in FIG. 2, the geometry of the spatially periodic distribution of each array 20/30 is defined such that any three mutually adjacent elements are located at respective corners of an equiangular (60°) triangle-based lattice. This results in an overall array lattice geometry comprised of three mutually rotated (by 60°) sets of parallel rows of antenna elements, the mutual spacing S between any two of which is the same. The mutual spacing S is selected to avoid mutual coupling between elements and may be defined by the relationship:

$$S=10^{G(\lambda)/20}\lambda/\pi,$$

where $G(\lambda)$ is antenna element gain as a function of frequency in dB, and $\lambda$ is freespace wavelength.

In the array geometry of FIG. 2, each of the transmit and receive arrays is configured as a spatial (e.g., circular) truncation of the 60° lattice to realize sixty-four elements per array. Namely, the truncation of the lattice is such as to cause selected locations on the circular perimeter of a cut into the lattice to exclude potential locations of antenna elements, so as to leave a quasi-circular distribution of locations within the lattice at which a plurality (e.g. sixty-four) of tapered pitch helical antenna elements are installed.

In addition, as will be described below with reference to FIGS. 4 and 5, each (sixty-four element) array is subdivided into a plurality (e.g., four) of spatial sections (e.g., quadrants). Moreover, the (sixteen) antenna elements of a respective spatial section (quadrant) of the receive array are coupled through a prescribed amount of phase offset, that is controllably adjustable with respect to the phase offset of the antenna elements of each of the other spatial sections of the receive array. This spatial section-based phase offset among the antenna elements of respectively different sections of the receive array allows its beam pattern to be controllably tilted in a 'pseudo'-monopulse fashion, for controlling the antenna's (azimuth AZ—elevation EL) positioning subsystem, that is used to automatically track the orbit of the target (satellite). Moreover, as will be described, installing the RF circuitry for each array on the back of the panel not only avoids aperture blockage, but obviates the need to enlarge the antenna aperture for auxiliary monopulse horn components—a significant drawback of conventional (parabolic) dish architectures.

As pointed out above, the use of relatively low gain helical antenna elements in each regular array allows the antenna elements to be placed relatively close together without the introduction of substantial grating lobes. This means that, consistent with the low observable profile objective, a relatively large number of tapered pitch helices (e.g., sixty-four elements) may be placed within a relatively small antenna viewing (energy collection—transmission) aperture. In addition, to achieve a substantial reduction in the sidelobe envelope for complying with the DISA specification, the lattice geometries of the arrays 20/30 are positioned in a 'rotated' orientation on the support plate 10.

As shown by the dotted lines in FIG. 2, by 'rotated' is meant that each of the three sets of parallel rows of the 60° lattice geometry of a respective array is rotationally offset relative to both the target travel path 25 and the normal 26 to that path projected in the plane of the array. The projection of the antenna's scan plane 25 upon the array is defined by the orientation of the plate 10 in azimuth (AZ) and elevation (EL), under the control of the associated positioning subsystem upon which the plate is mounted, and corresponds to the projection upon the array of the travel path of the target (e.g., satellite) being tracked.

Orienting each of the arrays 20 and 30 on the plate 10 in such a 'rotated' manner causes the projected scan plane to encounter antenna elements of the array in a spatially aperiodic manner, and thus effectively conforms with the same physics employed by the spatially aperiodic array of the above-referenced '433 application, to constrain the sidelobes relative to the projected scan plane. In a practical implementation, this rotational offset may be readily achieved by spatially 'rotating' the arrays 20 and 30 relative to the mutually perpendicular sides of the rectangular plate 10, so that each of the sets of parallel rows of an array's 60° lattice geometry is offset by an acute angle $\theta$ relative to the side edges of the support plate 10, as shown in FIG. 2.

Figure 3:
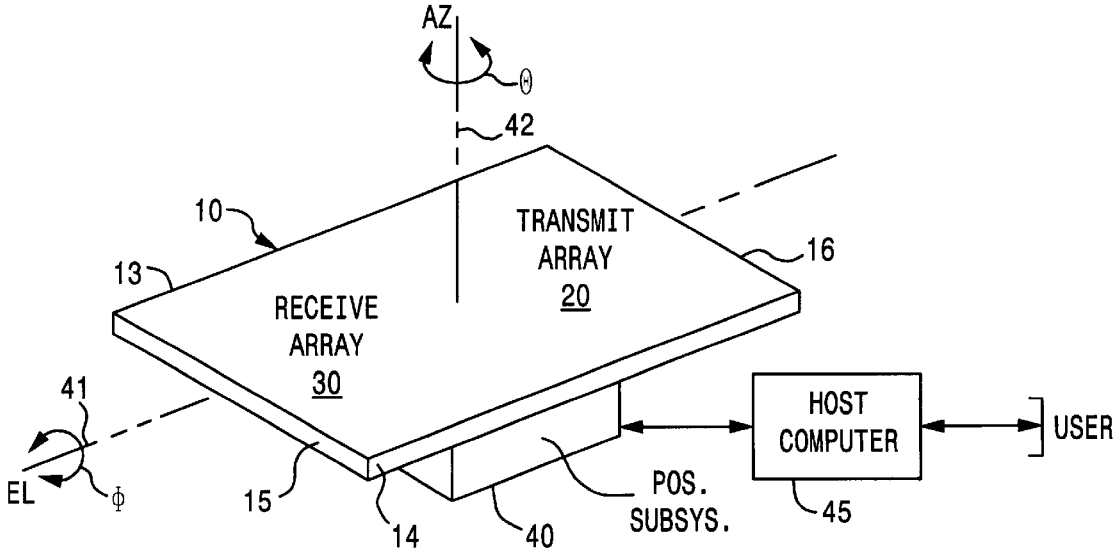
FIG. 3 diagrammatically illustrates an azimuth AZ and elevation EL (θ/Φ) subsystem for positioning the helical phased array antenna architecture of FIG. 1.

As diagrammatically shown in FIG. 3, the support plate 10 may be mounted to an associated azimuth AZ and elevation EL ($\theta/\Phi$) positioning subsystem. As described above, such a positioning subsystem is operative to effect a change in elevation EL by rotating or pivoting the plate 10 an angle $\Phi$ about an axis 41 that is parallel to the upper and lower parallel edges 13 and 14 of the plate. To effect a change in azimuth AZ, the positioning subsystem 40 rotates the plate 10 an angle $\Phi$ about an axis 42, the normal projection of which upon the plate 10 is parallel to its two parallel sides 15 and 16. Positioning control commands for driving the positioning subsystem are supplied by an associated system supervisory host computer 45. In a tactical environment, positioning vectors for the antenna system are readily derived from a stored orbit tracking algorithm for the satellite of interest, with the travel path data for the satellite look-up table adjusted by the host computer, in accordance with longitude and latitude coordinate information for the location of the antenna as derived from an associated global positioning system (GPS).

Figure 4:
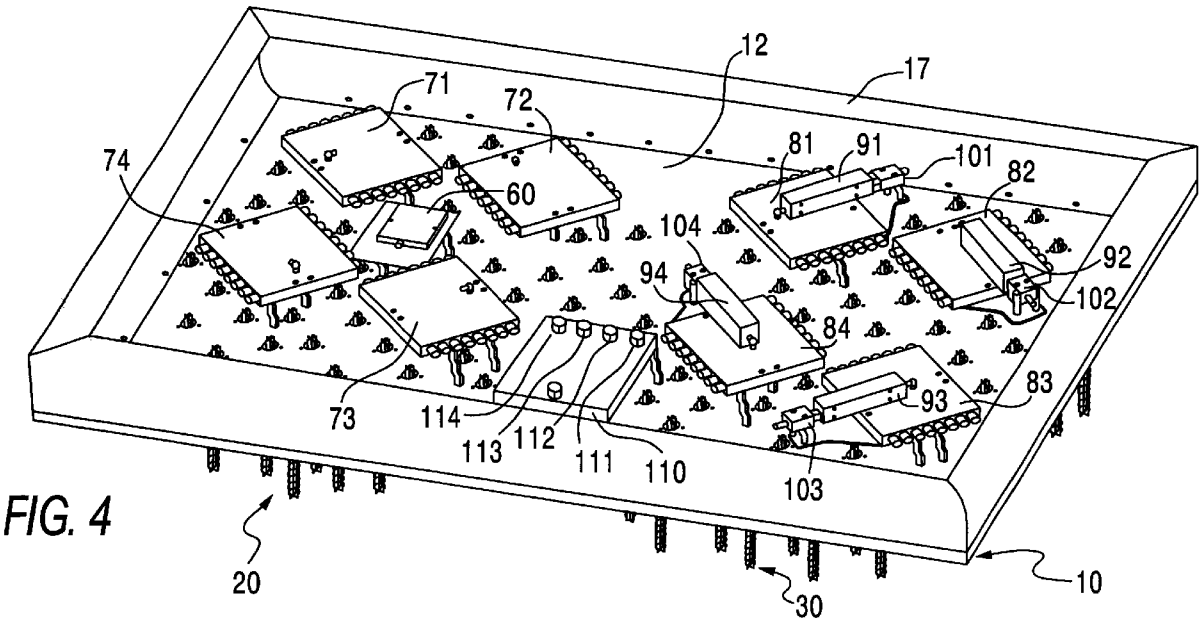
FIG. 4 is a perspective view of the RF circuit component side of the phased array antenna architecture of FIG. 1.

FIG. 4 is a perspective view of the rear (RF circuit component) side 12 of the low profile, panel-configured helical phased array antenna system of FIG. 1. As shown therein, associated with each of transmit and receive arrays 20 and 30 on the front side 11 of the plate 10 are respective arrangements of RF hardware components that implement the functionality of respective transmit and receive subsystems, shown at 26 and 36, respectively, in the functional block diagram of FIG. 5. To protect the RF components, perimeter walls 17 extend from the rear side 12 of the plate 10.

As pointed out above, and as shown in FIG. 2, each of the transmit and receive arrays 20 and 30 is spatially subdivided into a plurality spatial sections (or quadrants Q). In accordance with the 'pseudo' monopulse implementation of monopulse tracking of the invention, the downstream signal paths from the antenna elements of each quadrant of the receive array are coupled to receive respectively controllable amounts of phase offset, that allows the beam pattern of the array to be sequentially tilted with prescribed amounts of offset in azimuth and elevation. The amount of offset measured for each tilt interval is processed in accordance with a conventional monopulse-based beam tracking algorithm executed by the positioning subsystem's host processor to make the necessary azimuth and elevation adjustments to the antenna's pointing direction.

As a non-limiting example, each array 20/30 is shown in FIG. 2 as being subdivided into the four quadrants: $Q1_{TX}/Q1_{RX}$, $Q2_{TX}/Q2_{RX}$, $Q3_{TX}/Q3_{RX}$, $Q4_{TX}/Q4_{RX}$ of substantially equal spatial size, each quadrant having the same number of antenna elements per quadrant (e.g., sixteen in the illustrated example). It is to be understood, however, that the invention is not limited to these parametric examples, either from a standpoint of the number of sections per array, or the number of antenna elements per section. As long as an array is subdivided along more than one dimension into at least three sections, azimuth and elevational control may be achieved. For example, an array may be subdivided into three 120° sections of antenna elements having mutually offset phase shifts, and coupled to beam steering processing components that effect the appropriate steering algorithm for such a spatial configuration. Likewise more than four sections may be used. The choice of four quadrants (Q1–Q4) of the present example facilitates implementing electronically what are effectively equivalent to the sum and difference operations of standard monopulse tracking for the antenna's positioning subsystem in elevation (EL) and azimuth (AZ).

Figure 5:
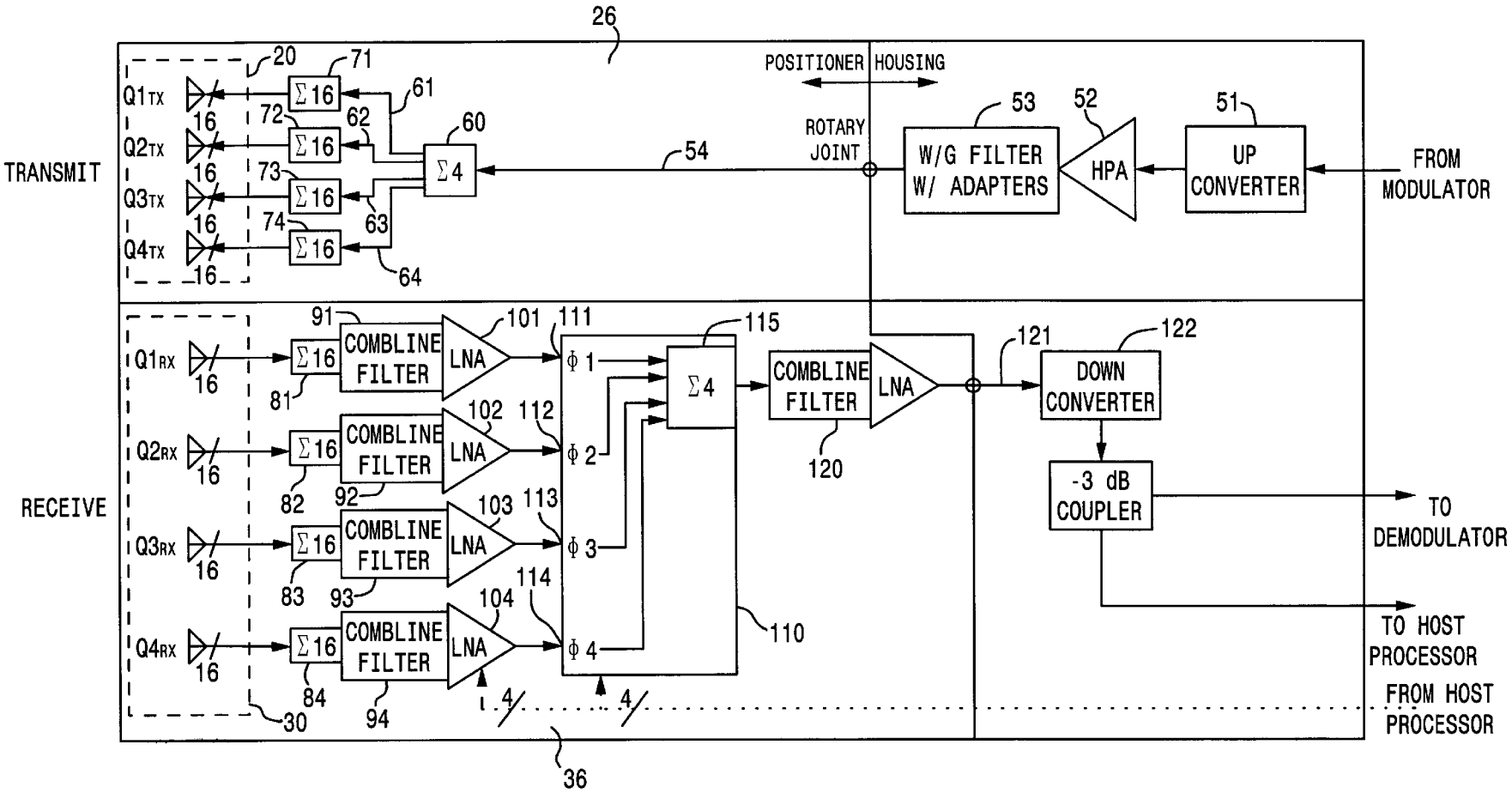
FIG. 5 is a functional block diagram of respective transmit and receive subsystems for the transmit and receive arrays of the phased array antenna architecture of FIG. 1.

As shown in FIG. 5, the transmit path from an upstream transceiver unit modulator to the input of the transmit array of the antenna system of the invention includes an RF circuitry subsection installed in a separate housing (not shown), comprised of a cascaded arrangement of an IF-RF up-converter 51, high power amplifier 52, and filter 53. The output of the filter 53 constitutes the input to the RF circuitry components for the transmit array 20, that are mounted on the rear side 12 of the panel 10. The output of the filter 53 is coupled through a coax feed 54 to a four-way power divider 60, mounted on the rear side 12 of the plate 10 at a generally central location of the transmit array 20, as shown in FIG. 4. The four respective output ports 61, 62, 63, 64 of the four-way power divider 60 are respectively coupled to four, sixteen-way power dividers 71, 72, 73 and 74, the output of each of which is coupled to the feed ports of an associated set of sixteen antenna elements of the four sub-arrays of antenna elements within the four quadrants $Q1_{TX}$, $Q2_{TX}$, $Q3_{TX}$, $Q4_{TX}$ of the transmit array 20.

For the receive array 30, the output ports of each of the sixteen antenna elements of the four quadrants $Q1_{RX}$, $Q2_{RX}$, $Q3_{RX}$, $Q4_{RX}$ are coupled via phase-matched, low loss coaxial cable to respective ones of a set of four sixteen-way microstrip power combiners 81, 82, 83 and 84. The outputs of the power combiners 81, 82, 83 and 83 are respectively directly coupled to associated combline filters 91, 92, 93, 94 to suppress the RF band of the signals emitted by the adjacent transmit array 20. These combline filters are coupled to respective low noise amplifiers (LNAs) 101, 102, 103, 104. The outputs of the LNAs are coupled to respective inputs 111, 112, 113, 114 of a four-way phase shifter and combiner 110, which is operative, under control of the host processor, to impart a controlled amount of phase shift to quadrant output signal path and sums the resulting (phase-shifted) inputs from the four quadrants $Q1_{RX}$, $Q2_{RX}$, $Q3_{RX}$, $Q4_{RX}$ of the receive array. The output of the four-way combiner 110 is coupled through a further combline filter-LNA stage 120 and routed therefrom via a section of low loss coaxial cable 121 to a down-converter 122 of a downstream transceiver's subsection, referenced above.

In order to selectively impart a controlled amount of phase shift to each input path, the four-way combiner 110 includes a set of four digitally controlled, single-bit, quadrant phase shifters $\Phi_1$, $\Phi_2$, $\Phi_3$, $\Phi_4$, such as conventional MESFET phase shift elements, the outputs of which are summed in a four-way summer 115. The amount of phase shift imparted by each phase shift element is defined in accordance with a programmable control voltage applied to its control input. Whether or not that control voltage is applied to the phase shift element is determined by the value of the single bit supplied to the voltage coupling circuit to the phase shift element.

Figure 6:
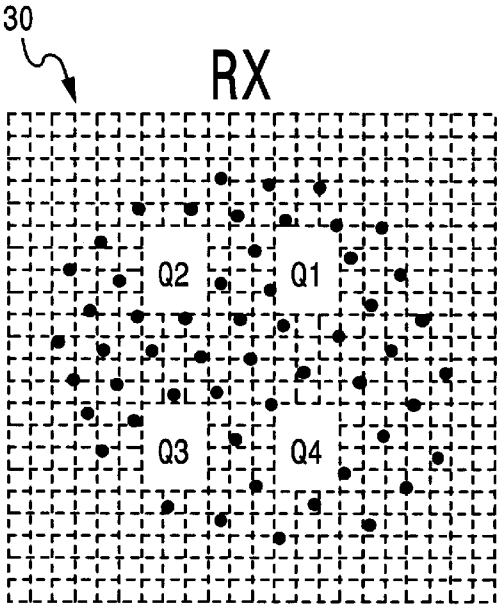
FIG. 6 is a table showing the relationship between states of the single bit phase shifters of the four-way phase shifter and combiner for the receive array of FIG. 1 and pseudo-monopulse tracking directions sequentially employed during tracking mode of operation.

FIG. 6 contains a table showing the relationship between the states of the respective phase shifters $\Phi_1$, $\Phi_2$, $\Phi_3$, $\Phi_4$ and pseudo-monopulse tracking directions (boresight, left, right, up, down) that are sequentially employed during tracking mode of operation. The use of digitally controlled phase shifters facilitates (the programming of) adjustments to the associated pseudo-monopulse tracking subsystem, to allow the main beam to be selectively scanned or tilted up to a prescribed offset angle (e.g., 1°) from boresight. During pseudo-monopulse tracking mode, this selective tilting is carried out to extract azimuth and elevation error signals used by the positioning subsystem to correct, as necessary the pointing of the antenna.

At times other than this tracking mode, the digital programmability of each of the phase shifters allows the beam pattern of the array to be controllably tilted at a selected inclination angle off boresight, under user control, for example to align the insertion phase from quadrant to quadrant. This ability to electronically modify the behavior of the antenna constitutes a significant reduction in hardware complexity and down time encountered in a conventional dish/horn-based system in which mechanical components, such as waveguide shims, must be installed. The use of electronically controlled phase shifters also allows a trade-off between and simplifies optimization of tracking performance and gain/thermal noise ratio (G/T). In contrast, a conventional tracking coupler requires physically changing the coupler.

Figure 7:
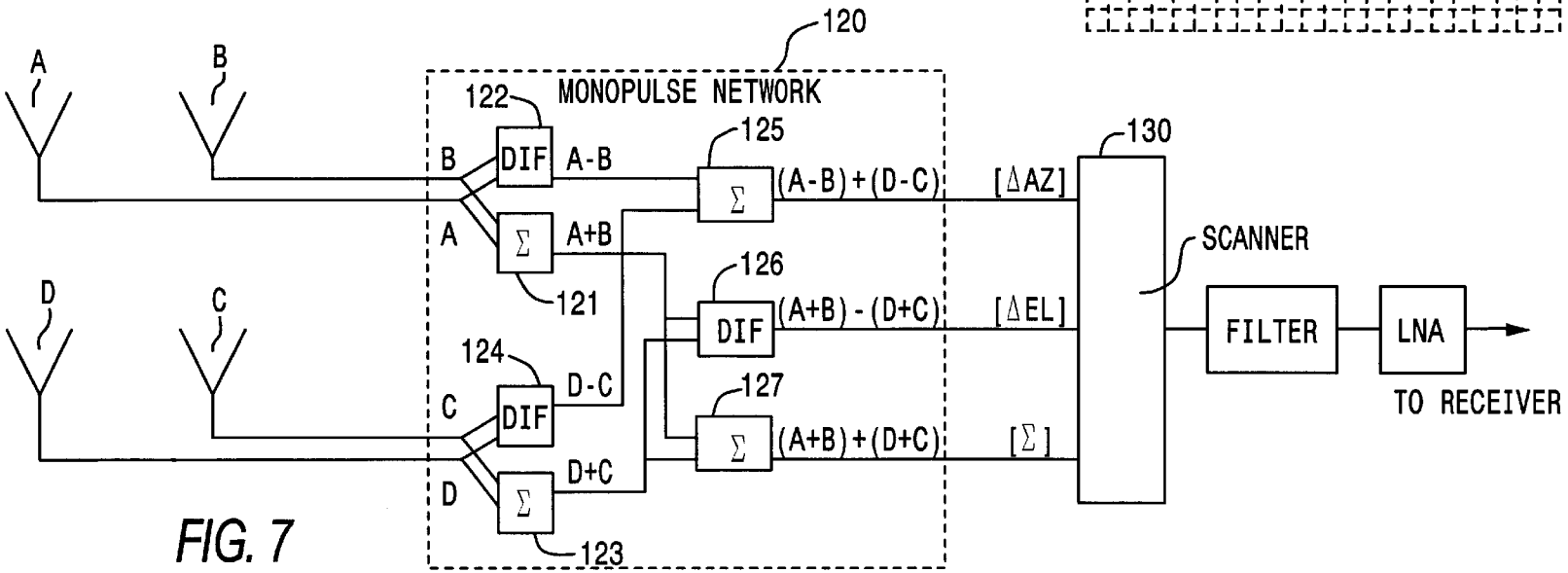
FIG. 7 diagrammatically illustrates a standard monopulse tracking network.

In order to appreciate the reduced complexity implementation of the 'pseudo'-monopulse beam control mechanism of the invention, it is useful to examine the configuration and operation of a standard monopulse tracking network, such as that diagrammatically illustrated at 120 in FIG. 7, that could be employed with the quadrant based helical phased array architecture of the invention. As shown therein, the summed signals for each of a set of four, relatively spatially quadrant antenna elements A, B, C and D are coupled to each of a first pair of sum and difference (hybrid) circuits 121 and 122, respectively. Similarly, the summed signals for each of antenna elements C and D are input to each of a second pair of sum and difference (hybrid) circuits 123 and 124, respectively. The outputs of difference circuits 121 and 123 are summed in summing circuit 125 to produce an output (A−B)+(D−C) representative of difference in azimuth from that supplied by a host controller. The outputs of summing circuits 122 and 124 are differentially combined in difference circuit 126, to produce an output (A+B)−(D+C) representative of difference in elevation from that supplied by the host controller. In addition, the outputs of summing circuits 122 and 124 are summed in summing circuit 127 to produce an output (A+B)+(C+D) representative of the total received energy. In FIG. 7, the respective AZ and EL errors and summation channel signals produced by the monopulse network 120 are shown as being applied to a scanner 130. The scanner 130 is operative to modulate the summation channel produced by summing circuit 127 with the AZ and EL error channel signals produced by summation circuit 125 and difference circuit 126, as necessary for monopulse tracking.

As noted earlier, the architecture and functionality of the four-way combiner 110 of the receive array processing architecture of FIG. 5 advantageously enables the invention to electronically provide what is in effect a 'pseudo' monopulse implementation of the monopulse tracking scheme of FIG. 7, without its attendant hardware. As described previously, rather than containing sum and difference hybrids as in the monopulse tracking network 120, and an associated scanner 130, the four-way combiner 110 contains a set of four one-bit phase shifters, respectively installed in the downstream signal paths from the antenna elements of each of the four quadrants of the receive array.

Each phase shifter is operative to impart a controllable amount of phase offset that is effective electronically impart a relatively narrow amount of tilt or offset (e.g., on the order of one degree) to the beam (up/down, right/left) relative to boresight. As pointed out previously, the bit value applied to a respective phase shift element indicates whether or not a prescribed (programmable) phase offset representative voltage is applied to that phase shift element. In accordance with the pseudo-monopulse tracking mechanism of the present invention, the positioning control algorithm executed by the control processor 45 is operative to sequentially apply the bit patterns or codes listed in FIG. 6.

As each bit pattern is applied to the set of four phase shifters $\Phi_1$, $\Phi_2$, $\Phi_3$, $\Phi_4$ of the four-way combiner 110, the combined output from the combline filter-LNA stage 120 is sampled and stored as a measure of received energy for the respective (90°—stepped) directions of electronic scan of the beam. These sampled values for the sequentially applied bit patterns for respectively different tilts of the beam pattern are then digitally processed in the host processor 45 using a monopulse tracking algorithm, to derive azimuth and elevation error signals to the positioning subsystem 40, so as to adjust the orientation of the plate 10 to remove the measured error.

As will be appreciated from the foregoing description, shortcomings of conventional, relatively massive parabolic (e.g., Cassegrain) dish-configured antenna architectures are effectively obviated by the 'low profile', panel-configured helical phased array antenna architecture of the invention. As pointed out above, this architecture not only exhibits a low observability footprint, but readily lends itself to use with a monopulse based, automatic platform positioning system to facilitate operation of a mobile platform-mounted positioner, and has a sidelobe performance that conforms with industry standards, such as the above-referenced DSCS specification.

While we have shown and described a preferred embodiment of the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. A phased array antenna architecture comprising:

a generally panel-configured support structure having first and second sides;

a spatially periodic generally planar array of tapered pitch helical antenna elements mounted on said first side of said support structure, and being subdivided into a plurality of spatial sections of antenna elements, and oriented such that the antenna elements of said spatially periodic array are spatially aperiodic to a travel path and a normal to said travel path of a target projected onto said generally planar array; and RF circuit components mounted on said second side of said support structure, and being coupled with said spatial sections of said tapered pitch helical antenna elements, said RF circuit components including digitally controlled phase shifters associated with respective ones of said plurality of spatial sections of antenna elements; and wherein said support structure is adapted to be physically oriented by a positioning system coupled thereto, said positioning system being operative to selectively control said digitally controlled phase shifters so as to electronically change the direction of the beam pattern of said spatially periodic array of tapered pitch helical antenna elements.

2. A phased array antenna architecture according to claim 1, wherein parameters of said tapered pitch helical antenna elements of said array are defined so as to constrain sidelobes of said array's directivity pattern within the DISA envelope of DSCS certification requirements.

3. A phased array antenna architecture according to claim 1, wherein said RF circuit components at said second side of said generally panel-configured support include a summing unit to which outputs of said digitally controlled phase shifters are coupled, and wherein said positioning system is operative to store information representative of the output of said summing unit for successive changes in the direction of the beam pattern of said spatially periodic array of tapered pitch helical antenna elements, and to process said information so as to derive error signals to correct, as necessary, pointing of the boresight of said antenna in a prescribed direction.

4. A phased array antenna architecture according to claim 1, wherein said spatially periodic array of tapered pitch helical antenna elements comprises a receiver antenna array, and further including a spatially periodic transmitter array of tapered pitch helical antenna elements supported adjacent to said receiver array at said first side of said support structure, and being subdivided into a plurality of spatial sections of antenna elements, and wherein said RF circuit components include transmit path RF circuit components coupled to distribute an RF signal to said plurality of spatial sections of antenna elements of said transmitter array.

5. A phased array antenna architecture according to claim 1, wherein said positioning system is configured to controllably adjust the azimuth and elevation of said support structure and thereby the boresight of said spatially periodic array of tapered pitch helical antenna elements, in accordance with a monopulse-based beam tracking algorithm.

6. A phased array antenna architecture comprising:

a generally panel configured support member having first and second sides, and being adapted to have its physical orientation controlled by a positioning system coupled thereto;

a spatially periodic array of tapered pitch helical antenna elements arranged in a plurality of spatial sections of antenna elements, disposed on said first side of said panel configured support structure, and having an associated beam pattern relative to a boresight thereof, and wherein a respective spatial section of said spatially periodic array of tapered pitch helical antenna elements is oriented such that said antenna elements are spatially aperiodic to the projected travel path and a normal to said projected travel path thereon of a target being tracked by said antenna;

antenna interface circuitry disposed on said second side of said generally panel-configured support, and being coupled with said spatial sections of said tapered pitch helical antenna elements, said antenna interface circuitry being controllably operative to sequentially electrically tilt said beam pattern in a plurality of respectively different directions relative to said boresight, and to provide respective signals representative of energy received by each of said sections of said spatially periodic array of tapered pitch helical antenna elements at each of said plurality of respectively different directions of tilt of said beam pattern; and a positioning system control unit which is operative to controllably cause said positioning system to adjust the physical orientation of said generally panel configured support member in accordance with information contained in said respective signals.

7. A phased array antenna architecture according to claim 6, wherein said antenna interface circuitry includes a plurality of electric signal responsive phase shifters, associated with respective ones of said plurality of spatial sections of antenna elements, and being operative to controllably tilt said beam pattern in accordance with electric signals applied thereto, and a summing unit to which outputs of said phase shifters are coupled, said summing unit being operative to provide said respective signals representative of energy received by each of said sections of said spatially periodic array of tapered pitch helical antenna elements at each of said plurality of respectively different directions of tilt of said beam pattern, as established by phase shifters.

8. A phased array antenna architecture according to claim 7, wherein said positioning system control unit is operative to sequentially apply respectively different combinations of electrical signals to said phase shifters so as to electronically change the direction of tilt of said beam pattern.

9. A phased array antenna architecture according to claim 8, wherein said spatial sections of antenna elements correspond to four spatial quadrants of antenna elements, and wherein said electric signal responsive quadrant phase shifters comprise digitally controlled single bit phase shifters respectively associated with different spatial quadrants of antenna elements.

10. A phased array antenna architecture according to claim 9, wherein said positioning system control unit is operative, during a pseudo-monopulse tracking mode of operation of said antenna, to sequentially apply respectively different combinations of digital codes to said quadrant phase shifters, and thereby electrically change the direction of tilt of said beam pattern, so as to extract azimuth and elevation error signals that are coupled to said positioning subsystem to correct, as necessary the pointing of beam pattern of said antenna.

11. A phased array antenna architecture according to claim 7, wherein parameters of said tapered pitch helical antenna elements of said array are defined so as to constrain sidelobes of said array's beam pattern within the DISA envelope of DSCS certification requirements.

12. A phased array antenna architecture according to claim 7, wherein said spatially periodic array of tapered pitch helical antenna elements comprises a receiver antenna array, and further including a spatially periodic transmitter array of tapered pitch helical antenna elements supported adjacent to said receiver array at said first side of said generally panel configured support member, and being subdivided into a plurality of spatial sections of transmitter array antenna elements, and wherein said antenna interface circuitry includes transmit path RF circuit components coupled to distribute an RF signal to said plurality of spatial sections of transmitter array antenna elements.

13. A phased array antenna architecture according to claim 6, wherein said positioning system is configured to controllably adjust the azimuth and elevation of said generally panel configured support member, and thereby the boresight of said spatially periodic array of tapered pitch helical antenna elements, in accordance with a monopulse-based beam tracking processing of said information contained in said respective signals.

14. A method of interfacing electromagnetic energy with respective to a remote communication device comprising the steps of:

(a) providing a generally planar spatially periodic array of tapered pitch helical antenna elements arranged in a plurality of spatial sections of antenna elements, and having an energy interface aperture through which a beam pattern of said array is defined relative to a boresight thereof, and wherein a respective spatial section of said spatially periodic array of tapered pitch helical antenna elements is oriented such that said antenna elements are spatially aperiodic to the projected travel path and a normal to said projected travel path thereon of a target being tracked;

(b) arranging antenna interface circuitry adjacent to said spatially periodic array of tapered pitch helical antenna elements, without encroaching upon said energy interface aperture thereof, and coupling said antenna interface circuitry to said spatially periodic array of tapered pitch helical antenna elements;

(c) operating said antenna interface circuitry so as to sequentially electrically tilt said beam pattern in a plurality of respectively different directions relative to said boresight, and thereby generating respective signals representative of energy received from said remote communication device by each of said sections of said spatially periodic array of tapered pitch helical antenna elements at each of said plurality of respectively different directions of tilt of said beam pattern; and (d) controllably adjusting the physical orientation of said generally planar spatially periodic array of tapered pitch helical antenna elements relative to said remote communication device in accordance with information contained in the respective signals generated in step (c).

15. A method according to claim 14, wherein step (c) comprises sequentially applying respectively different combinations of electrical signals to said phase shifters so as to electronically change the direction of tilt of said beam pattern.

16. A method according to claim 14, wherein said antenna interface circuitry includes a plurality of electric signal responsive phase shifters, associated with respective ones of said plurality of spatial sections of antenna elements, and being operative to controllably tilt said beam pattern in accordance with electric signals applied thereto, and wherein step (c) comprises summing outputs of said phase shifters to provide said respective signals representative of energy received by each of said sections of said spatially periodic array of tapered pitch helical antenna elements at each of said plurality of respectively different directions of tilt of said beam pattern, as established by phase shifters.

17. A method according to claim 14, wherein step (d) comprises, for a pseudo-monopulse tracking mode of operation of said antenna, sequentially applying respectively different combinations of electrical signals to said phase shifters, and thereby electrically change the direction of tilt of said beam pattern, so as to extract azimuth and elevation error signals that are employed in step (d) to correct, as necessary the pointing of beam pattern of said antenna.

* * * * *

UNITED STATES PATENT AND TRADEMARK OFFICE

CERTIFICATE OF CORRECTION

PATENT NO. : 6,243,052 B1
DATED : June 5, 2001
INVENTOR(S) : M. Larry Goldstein, Emil G. Svatik, Jr., James B. Offner, William C. Daffron, Alen Fejzuli It is certified that error appears in the above-identified patent and that said Letters Patent is hereby corrected as shown below:

Drawings,
FIG. 6,

| BEAM/PHASE SHIFTER STATE | Q1 | Q2 | Q3 | Q4 |
|---|---|---|---|---|
| BORESIGHT | 0 | 0 | 0 | 0 |
| LEFT | 1 | 0 | 0 | 1 |
| RIGHT | 0 | 1 | 1 | 0 |
| UP | 0 | 0 | 1 | 1 |
| DOWN | 1 | 1 | 0 | 0 |

FIG. 6

Column 4,
Line 34, delete "within with the DISA" insert -- within the DISA --
Line 40, delete "a periodic" insert -- aperiodic --

Column 7,
Line 34, delete "81, 82, 83 and 83" insert -- 81, 82, 83 and 84 --

Signed and Sealed this

Nineteenth Day of March, 2002

*Attest:*

*Attesting Officer*

JAMES E. ROGAN
*Director of the United States Patent and Trademark Office*